United States Patent [19]

Kameyama et al.

[11] 4,425,036

[45] Jan. 10, 1984

[54] APPARATUS FOR DRIVING A PHOTOSENSITIVE MEDIUM

[75] Inventors: Toru Kameyama, Tokyo; Junji Ichikawa, Kawasaki, both of Japan

[73] Assignee: Canon Kabushiki Kaisha, Tokyo, Japan

[21] Appl. No.: 398,829

[22] Filed: Jul. 16, 1982

[30] Foreign Application Priority Data

Jul. 24, 1981 [JP] Japan ..... 56-115995

[51] Int. Cl.[3] ..... G03G 15/00

[52] U.S. Cl. ..... 355/3 DR; 74/22 R; 355/133

[58] Field of Search ..... 355/3 R, 3 DR, 133, 355/8, 11; 74/22

[56] References Cited

U.S. PATENT DOCUMENTS 3,926,515 12/1975 Nagahara ..... 355/3 R

*Primary Examiner*—R. L. Moses

*Attorney, Agent, or Firm*—Fitzpatrick, Cella, Harper & Scinto

[57] ABSTRACT

A photosensitive medium driving apparatus comprises a photosensitive medium driven rotatable in the circumferential direction at a uniform peripheral speed, a driving source for rotating the photosensitive medium, and a supporting member for supporting the photosensitive medium for movement in the axial direction of the medium, wherein the photosensitive medium is movable in the axial direction in relation to the rotation of the medium.

7 Claims, 6 Drawing Figures

APPARATUS FOR DRIVING A PHOTOSENSITIVE MEDIUM

BACKGROUND OF THE INVENTION

1. Field of the Invention

The present invention relates to an apparatus for driving a photosensitive medium in copying machines, printers, recorders or other machines including a photosensitive medium to be driven into rotation (including those photosensitive media in the form of a drum or in the form of a belt). More particularly, the present invention relates to a photosensitive medium driving apparatus which can shift the position of the circumference of the photosensitive medium in the axial direction according to the number of the working rotations of the photosensitive medium.

2. Description of the Prior Art

In the above-mentioned types of machines employing a photosensitive medium, for instance, in an electrophotographic recording machine, the surface of the photosensitive medium is contacted by a cleaning blade under pressure at the cleaning station after transferring the developed image. While maintaining the pressure contact between the drum surface and the cleaning blade, the toner remaining on the drum surface is removed by the cleaning blade. In general, the positional relation between the cleaning blade and the photosensitive drum at the cleaning station is fixed with regard to the axial direction of the drum. This means that the cleaning blade always rubs the drum surface at the same area of the drum surface. Therefore, if the cleaning blade has any torn portion thereon or if there is any foreign matter between the blade and the drum, a scratch may be formed on the drum surface. When such a scratch is formed, it gradually expands over the drum surface as the number of cleanings conducted on the drum surface increases. Consequently, the photosensitive drum is rapidly degraded and its useful life is shortened.

In the case of laser beam printers there is another problem relating to the photosensitive medium.

The problem is that after a number of printing cycles are continuously carried out with the same format, the pattern of the format remains in the photosensitive layer as a memory. After changing the format from one to another, the memorized pattern of the previously used format appears on the print of the new format as a thin pattern image. The memory does not disappear at once but remains for a relatively long time after starting the printing with the new format.

As a solution to the above problems it has already been proposed to shift the photosensitive drum in the axial direction each time the number of prints made reaches a predetermined value. However, this known solution has the following drawbacks:

(1) Since the photosensitive drum is moved stepwise each determined number of prints, it is impossible to erase the memory in it by this solution.

(2) The positional relation between the photosensitive drum and the cleaning blade remains unchanged during the period between one step shift and the next step shift of the drum. Therefore, with regard to this period, the same surface area of the drum is subject to the abrasive force of the blade, which results in the expansion of the scratch previously formed on the surface.

(3) To shift the drum in the axial direction there is required an additional motor and clutch and the control circuits for them. The manufacturing cost of the apparatus rises accordingly. Furthermore, an additional relatively large space is required.

(4) During the time of the drum shift, the printing operation has to be stopped. Therefore, it is impossible to carry out successive printings without interruption.

SUMMARY OF THE INVENTION

Accordingly, it is the general object of the invention to overcome the above problems and provide a novel apparatus for driving a photosensitive medium.

A more specific object of the invention is to provide a photosensitive medium driving apparatus which shifts the position of the circumference of the photosensitive medium in the axial direction not stepwise but continuously according to the number of working rotations of the medium.

To attain the objects according to the invention there is provided a photosensitive driving apparatus which is essentially characterized in that it continuously shifts the photosensitive medium in relation to the peripheral rotation of said medium driven at a constant peripheral speed. With the arrangement of the apparatus according to the invention, the following advantages are obtainable:

(1) Since the photosensitive medium is continuously shifted in the axial direction, the problem of a memory in the medium is eliminated.

(2) Even if the cleaning blade has any torn portion or any foreign matter is present between the blade and the medium surface, the adverse effect thereof is dispersed over the whole surface area. The adverse effect is not concentrated on a limited area of the medium surface. Therefore, as compared with the above stepwise shift according to the prior art, the useful life of the photosensitive medium is substantially due to the invention.

(3) No additional driving means such as a motor and clutch is required for it.

(4) The structure is simple and compact.

Other and further objects, features and advantages of the invention will appear more fully from the following description of the preferred embodiments taken in connection with the accompanying drawings.

DESCRIPTION OF THE PREFERRED EMBODIMENTS

Figure 1:
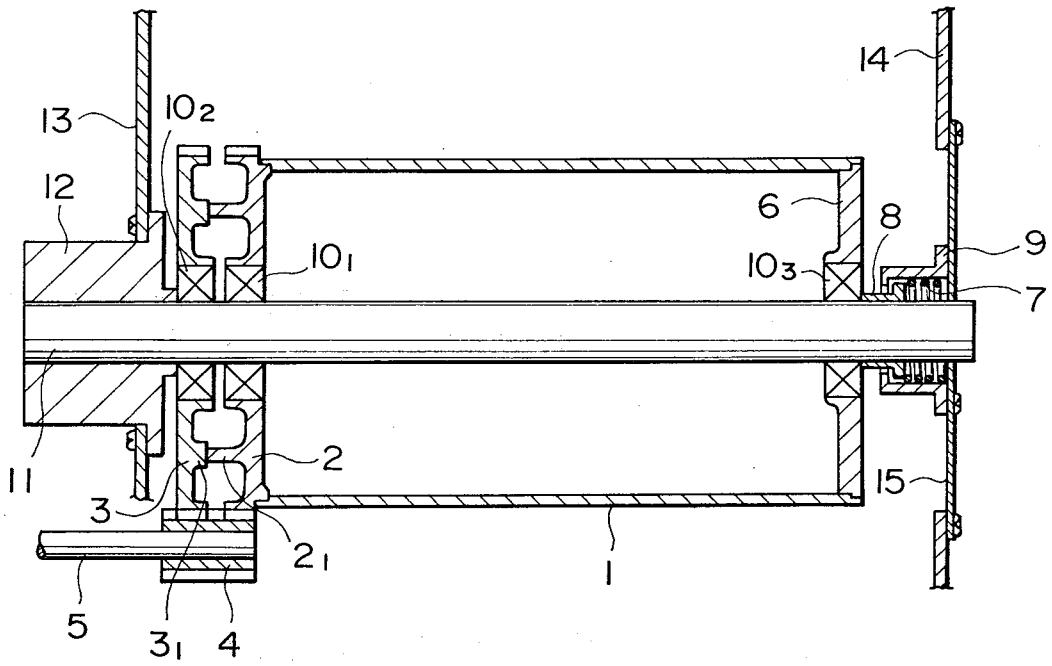
FIG. 1 is a schematic sectional view showing an embodiment of the invention.

Referring first to FIG. 1 showing an embodiment of the invention, 1 is a photosensitive drum having a gear flange 2 fitted to the drum at one end. A ball bearing $\mathbf{10}_1$ is press-fitted into the inner bore of the gear flange 2. The gear flange has also a projection $\mathbf{2}_1$. 3 is a differential gear having a cam $\mathbf{3}_1$. Like the gear flange 2, the differential gear 3 has a ball bearing $\mathbf{10}_2$ press-fitted into the inner bore of it. The gear ring of the differential gear 3 is shifted and the number of teeth on the gear 3 is different from that of the gear 2 by one or two teeth. 4 is a driving gear in mesh with both of the gears 2 and 3.

to transmit the turning force thereto. 5 is a driving gear shaft which receives a driving force from a main body driving motor (not shown) through a chain or other transmission means.

At another end, the photosensitive drum 1 has a flange 6 fitted thereto. Also, a ball bearing $10_3$ is press-fitted into the inner bore of the flange 6. 7 is a compression spring which is pushing the drum 1 leftwards so as to attain a close contact between the projection $2_1$ of the gear flange 2 and the cam $3_1$ of the differential gear 3. 8 is a collar through which the force of the compression spring 7 is transmitted to the inner race of the ball bearing $10_3$. The compression spring and the collar 8 are received in a housing 9 fixed to a centering plate 15.

11 is a drum shaft for supporting the drum 1. The drum shaft 11 is supported on the main body of the apparatus through a shaft support 12. The right-hand end of the support 12 receives also the inner race of the ball bearing $10_2$. 13 is a main body frame and 14 is a right-hand frame of the main body.

The manner of operation of the above apparatus is as follows:

With the rotation of the driving gear 4, the photosensitive drum 1 is rotated together with the gear flange 2. At the same time, the differential gear 3 also rotates. Due to the difference in the number of teeth between the gears 2 and 3, a sliding motion of the projection $2_1$ along the cam $3_1$ is caused.

Figure 2:
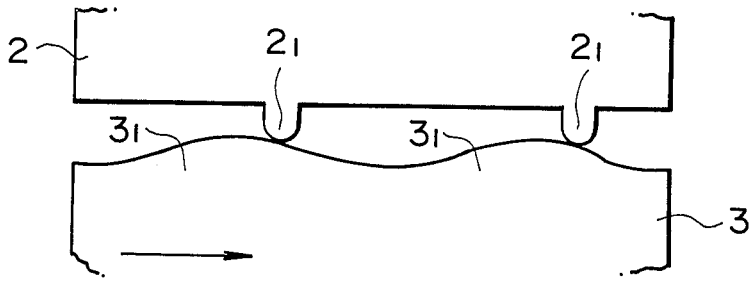
FIGS. 2 and 3 are expansion plan views of the cam portion of the embodiment of FIG. 1.

FIG. 2 shows the relation between the cam $3_1$ and the projection $2_1$ in a view expanded in the circumferential direction. In the expansion, the cam $3_1$ describes two cycles of a sine curve. Two projections $2_1$ are present on the whole circumference. Therefore, when the sliding motion, which results from the rotation of the two gears 2 and 3 occurs, the photosensitive drum 1 reciprocates in the axial direction in the form of a sine curve corresponding to the form of the cam $3_1$.

As an example, let the drum diameter be 200 (mm), the number of teeth on the gear flange be 200 and that of the differential gear be 201. Then, the drum 1 will reciprocate at the periodic frequency of one time per 100 revolutions. In the case where printing is carried out on the printing gear of A4 format while feeding the paper in the fashion of short side feeding, the reciprocation of the drum 1 will be repeated at the frequency of one time per about 250 sheets.

Figure 3:
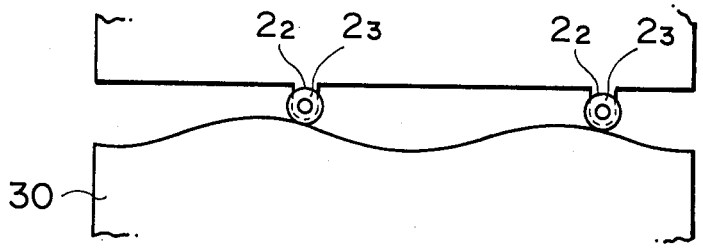

To reduce the contact resistance between the projection and the cam, a ball bearing $2_3$ may be applied to the projection $2_2$ as shown in FIG. 3. In this case, the cam 30 and other parts may be entirely the same as in FIG. 2.

Figure 4:
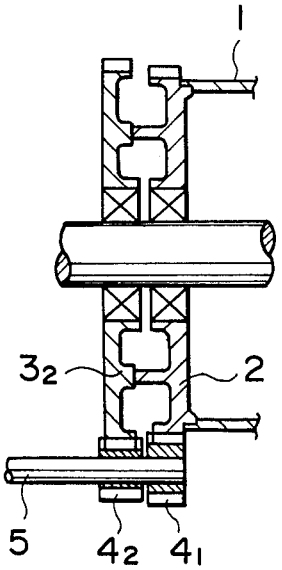
FIGS. 4 and 5 show modifications of the embodiment.
Figure 5:
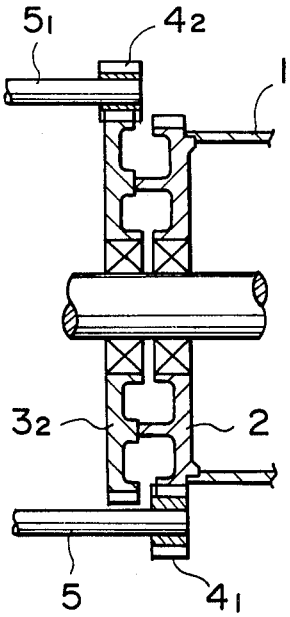

FIGS. 4 and 5 show modifications of the first embodiment.

In the modification shown in FIG. 4, the driving gear 4 in the first embodiment is divided into two separate gears $4_1$ and $4_2$ which are different from each other in the number of gear teeth. In this modification, the shift of the differential gear $3_2$ is no longer necessary. In addition, different gear modules can be selected for the gear flange 2 and the differential gear $3_2$. By selecting a smaller module for the differential gear $3_2$ than that for the gear 2 thereby reducing the difference in speed between the two gears, the cycle of the drum shift can be made longer than that of the first embodiment of FIG. 1 without decreasing the allowable value of rotation driving force to the drum 1.

In the modification shown in FIG. 5, the driving gears $4_1$ and $4_2$ are mounted on separate driving shafts 5 and $5_1$. With this arrangement, like the above modification of FIG. 4, the gear shift is dispensable. Also, the cycle of the drum shift can be made longer by suitably selecting the gear module so as to reduce the difference in speed between the gear flange 2 and the differential gear $3_2$. Since two separate driving shafts are used, the frequency of revolution of the two driving shafts can be selected at will and independently of each other. Therefore, it is possible to further reduce the difference in speed between the two gears 2 and $3_2$ in order to obtain a longer cycle of drum shift than that in the modification of FIG. 4 by employing a suitable combination of the number of gear teeth and the gear modules of the four gears, gear flange 2, differential gear $3_2$, driving gear $4_1$ and driving gear $4_2$. In the case of FIG. 5 modification, it is also possible to select the same number of teeth, the same module and shift for the gear flange 2 and the differential gear $3_2$ and also select the same number of teeth, the same module and shift for the two driving gears $4_1$ and $4_2$ while giving a small difference in frequency of revolution between the two driving shafts 5 and $5_1$ only.

In the above shown embodiments, there has been used a gear train as driving means. However, it is to be understood that the objects of the present invention may be attained also in the case of a belt driving system. In this case, the respective gears described above will be replaced by belt pulleys. Also, the gear flange shown in FIGS. 1, 4 and 5 may be divided into two separate parts, a gear and a drum flange.

Figure 6:
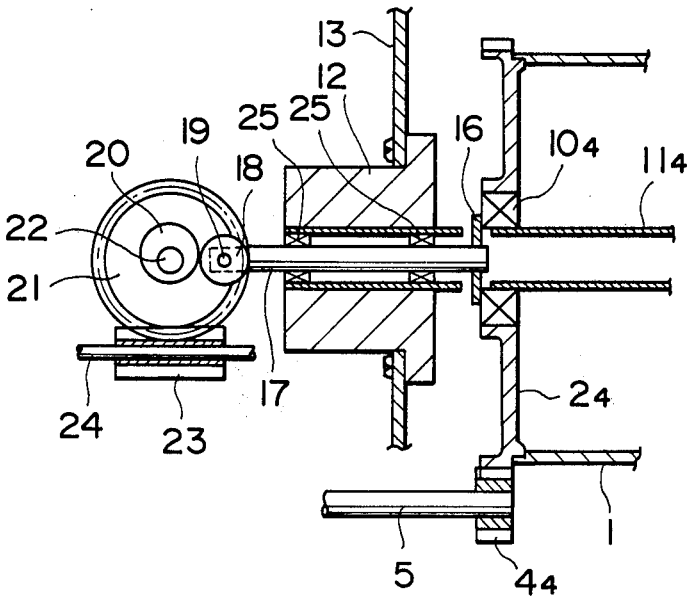
FIG. 6 is a schematic sectional view showing another embodiment of the invention.

Another embodiment of the invention is shown in FIG. 6 wherein the same reference numbers as in FIG. 1 represent the same or corresponding elements.

In FIG. 6, the photosensitive drum has a gear flange $2_4$ fitted thereto at one end of the drum. A ball bearing $10_4$ is press-fitted into the inner bore of the gear flange. $4_4$ is a driving gear, $11_4$ is a drum shaft in the form of a pipe. 16 is a pin for receiving the inner race of the ball bearing $10_4$. The pin 16 passes through one end of a slide shaft 17. 18 is a ball bearing whose outer race is rotatably mounted on an extension 19 of the slide shaft 17. 20 is an eccentric cam fixedly mounted on a shaft 22. The shape of the cam 20 is a circle, the center of which is shifted from the center of rotation of the cam. The eccentric cam is in contact with the ball bearing 18. Mounted also on the shaft 22 is a worm wheel 21. The eccentric cam 20 and the worm wheel 21 are united together to form a unitary body on the same shaft 22. The worm wheel 21 is in mesh with a worm 23 on a driving shaft 24. 25 is a sliding bearing. FIG. 6 shows only the left-hand half of the apparatus because the right-hand half of the apparatus has the same structure as that in FIG. 1.

The manner of operation of the second embodiment shown in FIG. 6 is as follows:

The photosensitive drum is rotated by the driving gear $4_4$ which in turn receives a driving force from the main driving motor (not shown) through a transmission system. Through another transmission means, the worm 23 also receives a driving force from the main driving motor and it rotates. With the rotation of the worm 23, the worm wheel in mesh with it also rotates. Since the worm wheel 21 and the eccentric cam 20 are united together, the latter also rotates. With the rotation of the eccentric cam, the slide shaft 17 reciprocates in the axial direction through the ball bearing 18. Since the drum 1 is being pushed against the pin 16 by the compression spring 7 (shown in FIG. 1), the drum 1 reciprocates in the axial direction in accordance with the reciprocation of the slide shaft 17.

To prevent the expansion of a scratch over the drum surface, it is desirable that the locus of movement of the cleaning blade on the drum surface falls on the previously described locus as little as possible. The most desirable thing is to avoid the overlap of the loci completely.

As the cycle of the reciprocation of the drum, T may be represented by:

$$T=f(n)$$

wherein, n is the number of rotations of the drum. It is desirable for T to have as many decimal places as possible, such as T=100.1234 . . . (rotations). If T is an irrational number, the overlap of the loci of the cleaning blade will never occur. Therefore, it is preferable that T be an irrational number. This effect becomes more remarkable when the integer value above the decimal point of T is a small number, that is, when the cycle is short.

Naturally, the axial movement of the photosensitive drum during recording causes some amount of shift of the position of the recorded image on the recording paper in the axial direction. Even on one and the same recording paper, the position of the recorded image at the beginning and that at the end are shifted from each other in an axial direction. The maximum amount of such shift occurs at the point of reversal in the direction of the axial movement of the drum. However, the amount of shift is negligibly small for practical purposes. For example, when the drum diameter is 200 (mm), the cycle is 100 revolutions and the axial movement of drum is 2 mm pp, the amount of image shift is less than 0.05 mm per the length of the short side of A4 format recording paper. Such a small shift does not bring about any problem for practical purposes. As the amount of shift is extremely small as shown in the above, a sliding movement in the axial direction occurring between the photosensitive medium and the recording paper at the transfer step produces no problem either.

While the invention has been particularly shown and described with reference to the preferred embodiments thereof, it will be understood by those skilled in the art that the foregoing and other changes in form and details can be made therein without departing from the spirit and scope of the invention.

We claim:

1. A photosensitive medium driving apparatus comprising:

a photosensitive medium rotatable in the circumferential direction;

a driving source for rotating said photosensitive medium in the circumferential direction at a uniform peripheral speed;

a supporting member for supporting said photosensitive medium for movement in the axial direction of said medium; and means for continuously moving said photosensitive medium in the axial direction in relation to the rotation of said medium.

2. A photosensitive medium driving apparatus comprising:

a photosensitive medium rotatable in the circumferential direction;

a driving source for rotating said photosensitive medium in the circumferential direction at a uniform peripheral speed;

a supporting member for supporting said photosensitive medium for movement in the axial direction of said medium;

a cam member rotatable independently of the rotation of said photosensitive medium so as to produce an axial displacement of said medium; and means for producing a phase shift between the rotation of said photosensitive medium and the rotation of said cam member.

3. A photosensitive medium driving apparatus as set forth in claim 1 or 2, wherein the axial movement of said photosensitive medium is a reciprocation which is repeated at a constant cycle.

4. A photosensitive medium driving apparatus as set forth in claim 2, wherein said cam member comprises a cam in the form of a sine curve.

5. A photosensitive medium driving apparatus as set forth in claim 2, wherein said rotation phase shift producing means operates gears, having different numbers of teeth, provided on said photosensitive medium and on said cam member respectively by means of one and the same gear.

6. A photosensitive medium driving apparatus as set forth in claim 2, wherein said rotation phase shift producing means operates gears provided on said photosensitive medium and on said cam member respectively by means of independent and separate gears.

7. A photosensitive medium driving apparatus as set forth in claim 6, wherein said independent and separate gears are mounted on the same shaft.

* * * * *